US008104451B2

(12) United States Patent
Schmieder

(10) Patent No.: US 8,104,451 B2
(45) Date of Patent: Jan. 31, 2012

(54) FUEL INJECTION DEVICE HAVING AN IMPROVED ELECTRICAL PLUG AND SOCKET CONNECTION

(75) Inventor: Dietmar Schmieder, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 345 days.

(21) Appl. No.: 12/454,801

(22) Filed: May 21, 2009

(65) Prior Publication Data

US 2009/0298318 A1 Dec. 3, 2009

(30) Foreign Application Priority Data

May 27, 2008 (DE) ..... 10 2008 001 994

(51) Int. Cl.
*F02M 51/00* (2006.01)
*F02M 51/06* (2006.01)

(52) U.S. Cl. ..... 123/490; 123/499

(58) Field of Classification Search ..... 123/472, 123/478, 490, 499, 143 C; 439/278, 527
See application file for complete search history.

(56) References Cited

U.S. PATENT DOCUMENTS

2005/0142930 A1* 6/2005 Arcykiewicz et al. ..... 439/527
2009/0291575 A1* 11/2009 Henry et al. ..... 439/89

* cited by examiner

*Primary Examiner* — Mahmoud Gimie
(74) *Attorney, Agent, or Firm* — Kenyon & Kenyon LLP

(57) ABSTRACT

A fuel injection device for injecting fuel includes an electrical-plug-and-socket connection configured as a modular component. The electrical-plug-and-socket connection includes an electric line region and exactly one one-piece plug contact molding. The plug contact molding surrounds the electric line region, and the plug contact molding forms a part of the outer geometry of the fuel injection device.

6 Claims, 3 Drawing Sheets

FUEL INJECTION DEVICE HAVING AN IMPROVED ELECTRICAL PLUG AND SOCKET CONNECTION

BACKGROUND OF THE INVENTION

1. Field of the Invention

The present invention relates to a fuel injection device for injecting fuel, having an improved electrical plug and socket connection.

2. Description of Related Art

Fuel plug and socket connections in diversified embodiments are known from the related art. The known plug and socket connections, in this instance, have to have an electrical connection which is usually developed as a plug and socket connection. The known electrical plug and socket connections, in this context, have an electric line region made of a current-conducting material that has been premolded. This electric line region having premolding is then mounted on the fuel injection device, and a final molding takes place in a last working step, whereby the electrical plug and socket connection is fixed on the fuel injection device. Thus, the assembly of the electrical plug and socket connection takes place because of the last molding process. In the known electrical plug and socket connections it is a disadvantage, however, that two molding processes are required, namely the premolding and the final molding. This leads to high costs and long production times. Furthermore, the final molding takes place on a ready assembled injector. This may result in a complete injector having to be scrapped in case of a possibly faulty final molding. Moreover, there is an increased danger of damage to the flat connector because of position tolerances in the tool, and the electrical plug connector is able be tested only after finished assembly. If a defect is detected at this point, the whole injector must also be scrapped. Consequently, while it is true that, because of the double plug connector molding of the known injectors, a simple assembly of the electrical plug and socket connection becomes possible, in an overall view it turns out that there are few cost advantages, because of the high reject costs.

BRIEF SUMMARY OF THE INVENTION

By contrast, the fuel injection device according to the present invention has the advantage that it represents a simple and cost-effective design. In the fuel injection device according to the present invention, a defective electrical plug and socket connection particularly does not lead to the complete scrapping of the entire fuel injection device, but only the electrical plug and socket connection has to be exchanged. Furthermore, the electrical plug and socket connection may be produced using only one molding process, in a simple and cost-effective manner. In addition, checking the electrical plug and socket connection may be performed before assembly into the fuel injection device. This ensures that only functioning electrical plug and socket connections are built. The present invention achieves this by developing the electrical plug and socket connection as a ready modular component and includes an electric line region and exactly one plug connector molding. The plug connector molding surrounds the electric line region, in this context, and an outer contour of the plug connector molding forms a part of the outer geometry of the fuel injection device. Consequently, a simply constructed modular component is able to be provided for the electrical plug and socket connection, according to the present invention, which, after production, is mounted on the fuel injection device, and forms a part of the outer geometry of the fuel injection device at the same time.

The electrical plug and socket connection preferably includes a sealing region, at least one of its ends, that is directed in the axial direction of the fuel injection device. This sealing region, together with an additional component of the fuel injection device, seals an inner region of the electrical plug and socket connection from spray water, etc., in this context. The sealing region may include an O-ring, for example, which is fitted into a groove after the molding process. It is particularly preferred if the plug contact molding has an integrally formed sealing region at both ends lying in the axial direction of the fuel injection device.

The sealing region of the plug contact molding is preferably an integrally formed protruding annular region made of the material of the plug contact molding. This achieves an encircling seal of the inside of the plug and socket connection.

It is also preferred if the electrical plug and socket connection also includes an inner ring which, as an insertion part of the plug connection molding is molded along with it. In the assembled state, in this instance, the inner ring forms a press fit with an inner component of the fuel injection device. In this context, the inner component is preferably an inner pipe, through which fuel is supplied.

The inner ring preferably includes one or more encircling radial grooves that are directed radially outwards. This enables a secure connection between the inner ring and the plug connector molding.

The plug contact molding according to the present invention is thus simply produced in such a way that the electric line region is applied in one molding form as an insertion part, and in a next step the plug contact molding is produced, the finished outer geometry of the plug connection molding being produced immediately, which is a part of the outer geometry of the fuel injection device. Because of that, the electrical plug and socket connection is developed as a modular component, and is able to be checked for functioning before assembly, and simply inserted.

DETAILED DESCRIPTION OF THE INVENTION

A fuel injection device 10 having an electrical plug and socket connection 1 is described in detail below, with reference to FIGS. 1 and 2.

Figure 1:
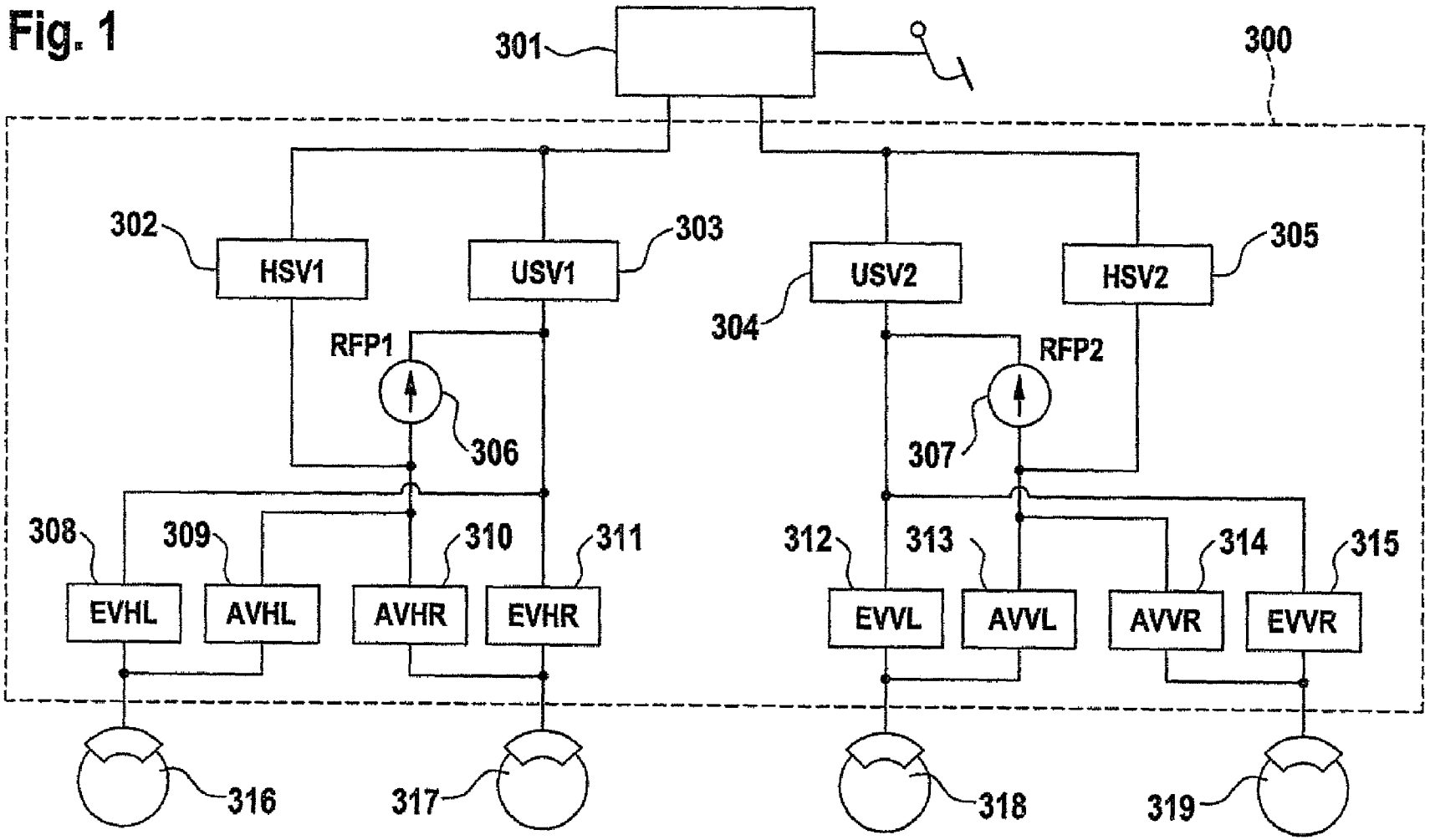
FIG. 1 shows a schematic sectional view of an electrical plug and socket connection according to a first exemplary embodiment of the present invention.
Figure 2:
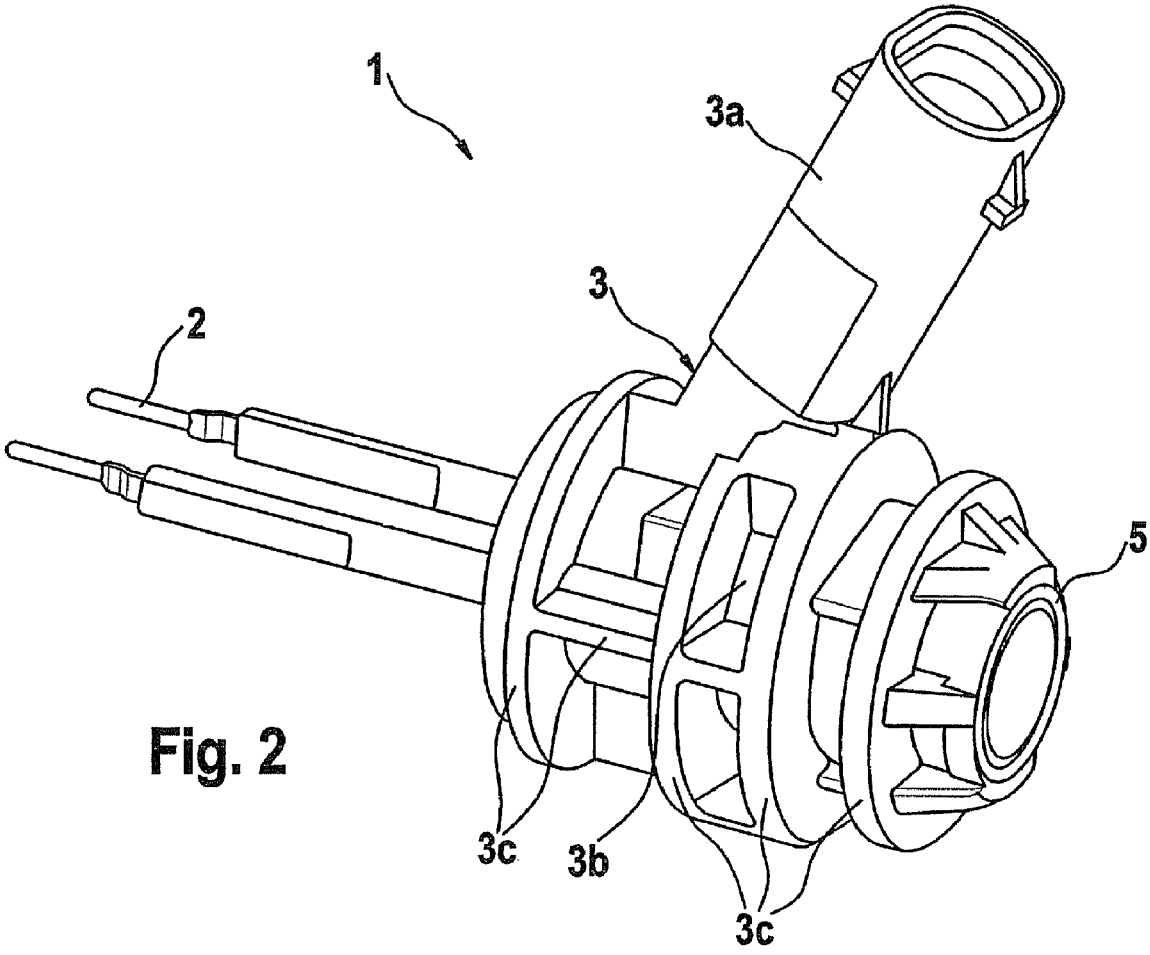
FIG. 2 shows a schematic perspective view of the plug and socket connection shown in FIG. 1.

As may be seen in FIGS. 1 and 2, electrical plug and socket connection 1 includes an electric line region 2 and exactly one single plug contact molding 3. Electric line region 2 includes two line sections made of a metallic material, running in parallel, which are each exposed at each end, in order to produce electrical contact, on the one hand, with a component of the fuel injection device and, on the other hand, with a line plug which is able to be plugged into a plug accommodation 3*a* of the electrical plug and socket connection. Electrical plug and socket connection 1 is produced in such a way that, in this instance, electric line region 2 is inserted as an insertion part into a tool mold and subsequently, in a single step, the complete plug connector molding 3 of the electrical plug and socket connection is produced. By this method the electrical plug and socket connection is developed as a modular component. As may be seen particularly in FIG. 2, the outer contour of plug contact molding 3 forms a part of the outer geometry of fuel injection device 10. As is clear in FIG. 2, the outer contour includes, in this context, plug accommodation 3*a* as well as a base region 3*b* that is directed in the axial direction X-X of fuel injection device 10. As may be seen in FIG. 2, base region 3*b* has a plurality of ribs 3*c* that are provided in the circumferential direction and in the axial direction, in order to lend great mechanical stability to the electrical plug and socket connection.

As may further be seen in FIG. 1, electrical plug and socket connection 1 also includes a first integrally formed sealing region 4 and a second integrally formed sealing region 5. In this exemplary embodiment, the two sealing regions 4, 5 are provided as protruding annular regions that are formed integrally with plug contact molding 3. Because of that, sealing regions 4, 5 may be produced in a particularly simple and cost-effective manner. First sealing region 4 provides a seal with a connecting piece 12 of fuel injection device 10, in this context. Second sealing region 5 provides a seal with a pressure ring 14. Pressure ring 14 is connected to a pipe element 11, through which fuel is supplied, using a press fit. Thus, the two sealing regions 4, 5 provide a radial seal of the inner region of fuel injection device 10, particularly from spray water, or the like. As may also be seen in FIG. 1, pipe element 11 and connecting piece 12 are rigidly connected to each other using a welding connection. First sealing region 4 is situated radially outside welding connection 13, in this instance.

Thus, the electrical plug and socket connection may be formed as a single modular component having an electric line region 2 and a plug contact molding 3, only one single molding process being required, in which the entire plug contact molding 3 is produced. This makes possible the testing of electrical plug and socket connection 1 before assembly. If there is a defect, only electrical plug and socket connection 1 has to be disposed of appropriately. The assembly of electrical plug and socket connection 1 takes place in the axial direction X-X of fuel injection device 10, in this context, by simply pushing the electrical plug and socket connection over pipe element 11 in axial direction X-X. Fixing electrical plug and socket connection 1 then takes place using pressure ring 14, which is pressed onto pipe element 11. Therefore, compared to the related art, one may do without particularly the final molding for producing the electrical plug and socket connection, which leads overall to a reduced scrap rate.

In the following, we shall describe in detail a fuel injection device 10 having an electrical plug and socket connection 1, according to a second exemplary embodiment, with reference to FIG. 3. The same or functionally the same parts are designated by the same reference numerals as in the first exemplary embodiment.

Figure 3:
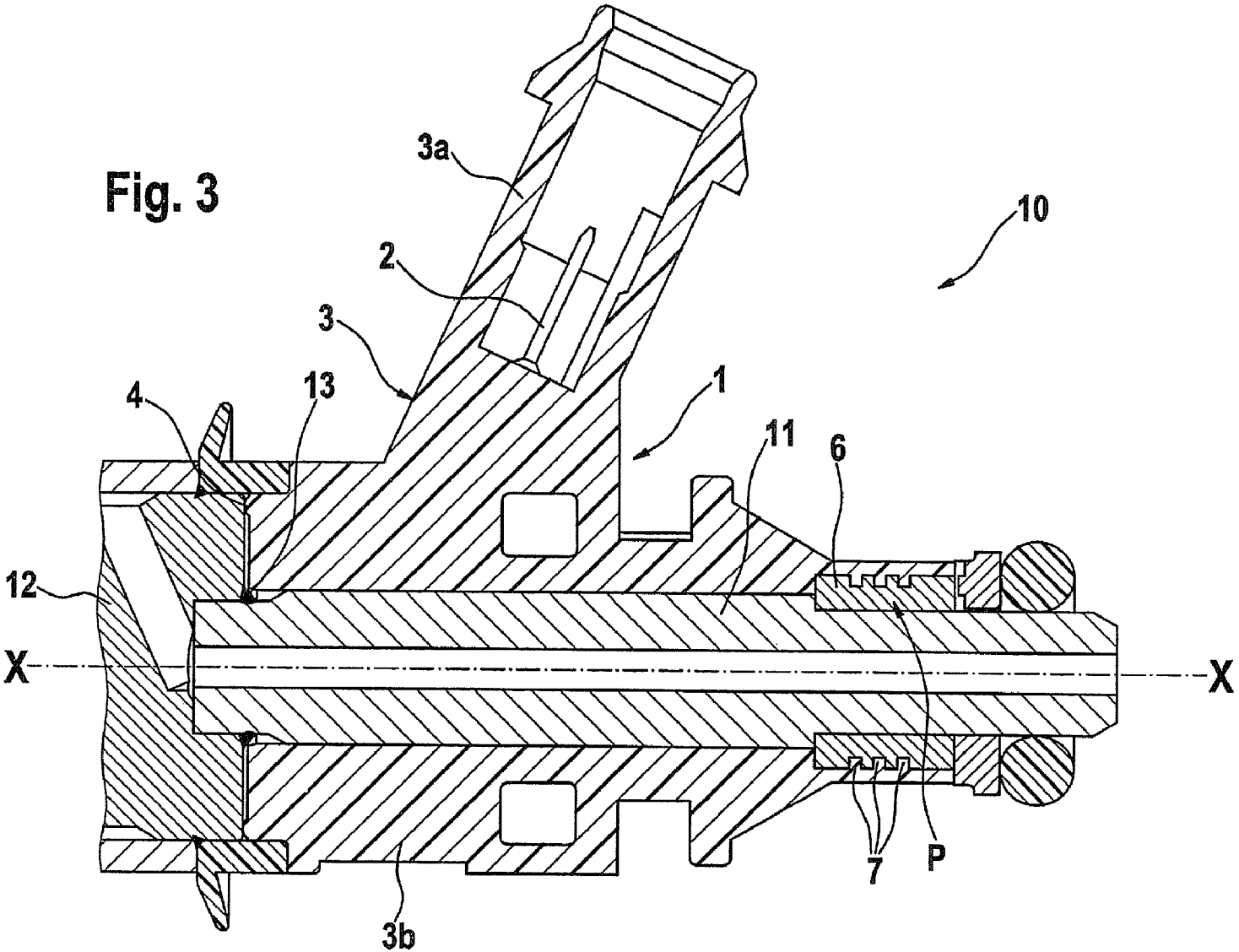
FIG. 3 shows a schematic sectional view of an electrical plug and socket connection according to a second exemplary embodiment of the present invention.

As may be seen in FIG. 3, in contrast to the electrical plug and socket connection of the first exemplary embodiment, in the second exemplary embodiment, an inner ring 6 is provided in addition. Besides electric line region 2, inner ring 6 is a second insertion component which is then fixed in one step along with plug contact molding 3. As may be seen in FIG. 3, inner ring 6 has encircling radial grooves 7 at its radial outer side 3. In this context, radial grooves 7 are used for the better fixing of inner ring 6 in plug contact molding 3. Plug contact molding 3 is in one piece, as in the first exemplary embodiment, and electrical plug and socket connection 1 is thus able to be produced in a very cost-effective manner. For the assembly of electrical plug and socket connection 1 of the second exemplary embodiment, it is pushed over pipe element 11 in the axial direction X-X, as in the first exemplary embodiment. In order to fix electrical plug and socket connection 1, between inner ring 6, which is an integral part of electrical plug and socket connection 1 that is developed as a modular component, and pipe element 11, a press fit P is developed. This press fit P between inner ring 6 and pipe element 11 also makes it possible to do without the second sealing region on electrical plug and socket connection 1. The plug and socket connection of the second exemplary embodiment consequently has only on sealing region 4 that is formed integrally with plug contact molding 3. Other than that, this exemplary embodiment is equivalent to the first exemplary embodiment, so that we may refer to the description given there.

What is claimed is:

1. A fuel injection device for injecting fuel, comprising:

an electrical-plug-and-socket connection configured as a modular component, wherein the electrical-plug-and-socket connection includes an electric line region and exactly one one-piece plug contact molding, the plug contact molding surrounding the electric line region, and the plug contact molding forming a part of an outer geometry of the fuel injection device, wherein the electrical-plug-and-socket connection includes a sealing region at one end of the electrical-plug-and-socket connection in the axial direction of the fuel injection device; and an inner ring configured as an insertion part of the one-piece plug contact molding and integrally molded with the one-piece plug contact molding, wherein the inner ring is configured to form a press fit with an inner component of the fuel injection device.

2. The fuel injection device as recited in claim 1, wherein the sealing region is integrally formed with the plug contact molding.

3. The fuel injection device as recited in claim 2, wherein the sealing region is an integrally formed, protruding annular region on the plug contact molding.

4. The fuel injection device as recited in claim 1, wherein the inner ring includes at least one encircling radial groove directed radially outwards.

5. The fuel injection device as recited in claim 1, wherein the electrical-plug-and-socket connection is configured to be mounted in the axial direction of the fuel injection device.

6. A fuel injection device for injecting fuel, comprising:

an electrical-plug-and-socket connection configured as a modular component, wherein the electrical-plug-and-socket connection includes an electric line region and exactly one one-piece plug contact molding, the plug contact molding surrounding the electric line region, and the plug contact molding including a base region forming a part of an outer geometry of the fuel injection device and a part of an inner bore of the plug contact molding, wherein the electrical-plug-and-socket connection includes a sealing region at one end of the electrical-plug-and-socket connection in the axial direction of the fuel injection device;

wherein the electric line region extends out of the plug contact molding in the axial direction of the fuel injection device; and wherein the base region includes a plurality of ribs situated circumferentially to the axial direction of the fuel injection device.

* * * * *